United States Patent [19]

Alkema et al.

[11] Patent Number: 4,912,517

[45] Date of Patent: Mar. 27, 1990

[54] HIGH-VOLUME PROJECTOR AND ROTARY XEROGRAPHIC PROCESSOR

[75] Inventors: Robert Alkema; John Van der Kruik, both of Walnut, Calif.

[73] Assignee: Micro-50, Inc., Walnut, Calif.

[21] Appl. No.: 177,676

[22] Filed: Apr. 5, 1988

[51] Int. Cl.[4] ..... G03G 15/00

[52] U.S. Cl. ..... 355/309; 355/297

[58] Field of Search ..... 355/3 R, 13, 50, 47, 355/48, 16

[56] References Cited

U.S. PATENT DOCUMENTS 4,233,386 11/1980 Aizawa et al. ..... 355/15 X 4,252,433 2/1981 Sullivan ..... 355/15

4,616,925 10/1986 Saijo et al. ..... 355/13 X

*Primary Examiner*—R. L. Moses

*Attorney, Agent, or Firm*—Frank Frisenda, Jr.

[57] ABSTRACT

The present invention provides improved method and apparatus for a high-volume projector and rotary xerographic processor. The unique apparatus produces dry, permanent positive copies from continuous fed microfilm which can be reproduced on plain paper continuous feed rolls at a rate of at least 52 feet per minute. Accordingly, the inventive apparatus and methods minimize the occurrence of blurred images through monitoring system which regulate microfilm transport providing alignment, precise, reflective optics and avoid "ripple effects" commonly associated with relatively high speed systems.

4 Claims, 7 Drawing Sheets

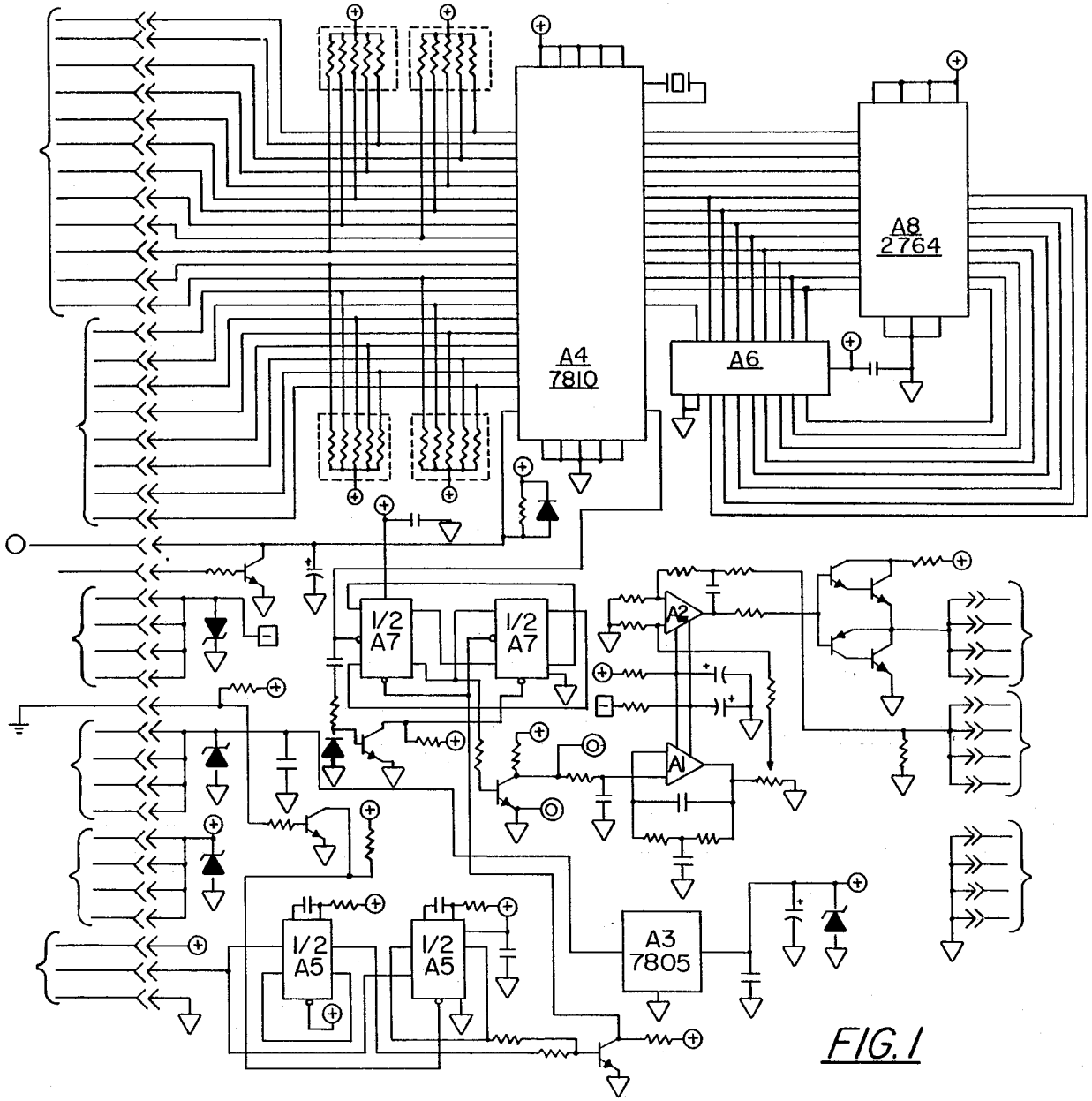
FIG. 1
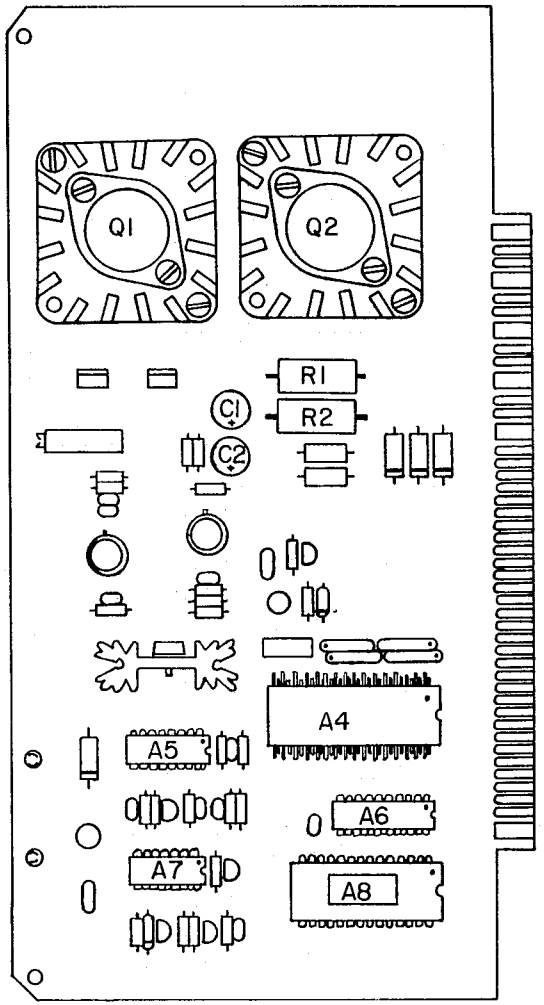

HIGH-VOLUME PROJECTOR AND ROTARY XEROGRAPHIC PROCESSOR

BACKGROUND OF THE INVENTION

This invention relates to a relatively high speed projector and rotary xerographic processor which produces dry, permanent, positive copies on continuous feed paper at a rate of at least 52 feet per minute.

Xerographic reproduction apparatus has been generally regarded as a necessity to many commercial enterprises since at least the early 1960's. The ability to produce permanent, positive copies on paper at a relatively high speed rate is particularly essential for obtaining and accessing stored microfilm records such as medical records, litigation pleading, technical literature and the like.

Johanson in U.S. Pat. No. 3049968 discloses a microfilm projection apparatus which was considered by many to be state-of-the-art in 1962, the date of issuance of his patent. The Johanson apparatus related particularly to an improved apparatus to project microfilm images at variable magnification ratios onto an electrostatically charged service of a xerographic plate which is moving normal to an exposure slit at constant rate. More specifically, the disclosure related to reproduction apparatus for use and conjunction with continuously xerographic printing apparatus for effecting xerographic reproductions at variable magnification ratios from continuously moving microfilm images onto a support service.

At one example of the process of xerography is disclosed in Carlson's Pat. No. 2297691. Reproduction of microfilm images onto a stationary receiving surface has conventionally been achieved by employing known projection techniques and the principals of silver-halide photography which may include means to effect magnification between the original and the image projected. Magnified projection of microfilm is usually attained using a single lens of appropriate fixed focal length mounted with its focal access in an optical path between the filmed image and receiving surface.

To effect projection at variable magnification ratios, means are provided to vary the length of the optical path and the lens position. To effect a wide range of magnification ratios by these means usually subjects the lens and optical path to a wide range of movement and renders the structure required therefore, impractical.

As an alternative, lenses of different focal lengths are manually interchanged to reduce the required range of movement. However, as stated in the Johanson patent, apparatus of this type is usually not suitable to automatic machines requiring compactness and rapid conversion over the full range of magnification ratios. In addition, when employing principals of silver-hallied photography the photo sensitive receiving service must be processed in accordance with methods well known in the photographic art which for expedient quantity reproduction is usually excessively time consuming and, therefore, considered objectionable for many applications. Because of these reproduction limitations encountered employing conventional apparatus for reproducing from microfilm, the use of microfilm as as a medium for recorded storing of printed matter is appreciably limited.

To effect quantity and continuous reproduction of images from moving microfilm, the surface receiving the projected image must also be continuously moving at a synchronized rate. Where it is intended to effect magnified projection the relative movement rates for each selected magnification ratio must be separately synchronized, that is, in a non-magnified projection from continuously moving microfilm, every lineal inch of image projected exposes a lineal inch on a receiving surface moving at the same rate; whereas, in an enlarged magnified projection of a 2 to 1 ratio, the length of film from which the image is projected consumes one half the moved length of the receiving surface, or in this instance, two inches of the receiving surface is exposed per inch of film projected. Therefore, an apparatus to effect projection over a wide range of magnification ratios onto a receiving surface moving at a constant rate requires cooperating apparatus enabling an inversely corresponding range of microfilm transport speeds.

Howard in U.S. Pat. No. 3732006 discloses a continuous microfilm or timing circuit which includes an SCR gate effective when turned on and off for respectively energizing and deenergizing shutter and clutch coils of the microfilmer.

Smitzer et al. in U.S. Pat. No. 3442585 discloses continuous rotary electrostaticgraphic apparatus for making micro images wherein a photo-conductive surface is moved in the direction of its lane through successive stations of charging, exposing and developing and simultaneously therewith a development electrode at the development station is reciprocated in a direction transverse to the direction of movement of the photo-conductive surface. Thus, the Smitzer disclosure provides a method and apparatus wherein micro images may be reproduced electrostatigraphically continuously so that the micro images may be recorded on a continuous strip of film.

Other know electrostatic copying apparatuses as well as related systems and equipment therefore are disclosed in the following U.S. Patents: U.S. Pat. Nos. 3,732,006; 3,442,585; 2,928,327; 2,829,025; 4,511,245; 4,227,803; 4,014,112; 4,685,798; 4,602,864; 4,530,596; 4,557,588; 4,090,787.

While generally satisfying the need of intermittent users such as law firms, physicians, offices and libraries and the like, those skilled in the art have recognized a particularly and improved projector and rotary xerographic processor which will provide a relatively high speed of reproduction, continuously, which produces dry, permanent, positive copies on plain paper rolls. Moreover, those skilled in the art have recognized a need for an apparatus which is conveniently operated by semi-skilled workers and which minimizes the occurrence of blurred images for producing "rippled effect" in the hard copy of documents reproduced. The present invention fulfills these needs.

SUMMARY OF THE INVENTION

The present invention resides in an improved method and apparatus for a high-volume projector and rotary xerographic processor. Briefly, and in general terms, the unique apparatus produces dry, permanent positive copies from continuous fed microfilm which can be reproduced on plain paper continuous feed rolls at a rate of at least 52 feet per minute.

In more detail, the xerographic processor contains all components necessary to reproduce the image from the projection component of the apparatus. The processor comprises an aluminum drum coated with a photosensitive selenium surface that is rotatable by a synchronous motor associated with drive means such as a gear reduction box. The processor further comprises charge corotron means, transfer corotron means, preclean corotron means and brush housing means.

As the drum rotates, the drum is charged by the charge corotron means. Light from the lens means teen strikes the selenium surface. The exposed surface then passes under the developer housing means where developer reagent cascades over the drum surface means, developing the film image. The reproduction substrate, for instance, paper, contacts the drum, transferring the image thereon by way of the transfer corotron means. Thereafter, the paper is carried through fuser means where the image is permanently fused to the paper. Thereafter, the now imaged paper continues through the paper feed roll means to the takeup shaft means where it is respooled. Concurrently, the drum continues to rotate past the preclean corotron means to the brush housing means. Therein, the drum means is brushed and vacuumed by brush and vacuum means before being recharged for continuous operation.

The inventive projector component of the apparatus is capable of imaging either 16 or 35 MM film, which can be accommodated by unique interchangeable film idler means. The microfilm is transported across film gate means via capstan motor means. A light source preferably is a 400 W Tungsten-Halogen lamp, although other suitable light means may be used for this purpose. As the microfilm is transported, an image is projected through the lens means to a set of mirrors. Within the optical mirror means, a plurality of mirrors are oriented in a prescribed manner to determine the appropriate magnification of the microfilm. A mirror image is then reflected to the selenium surface of the drum means referred to above.

It will be appreciated from the foregoing that the present invention provides a efficient method and apparatus for high-volume reproduction whereby positive, permanent dry copies may be produced from continuously fed microfilm. Accordingly, the inventive apparatus and methods minimize the occurrence of blurred images through monitoring systems which regulate microfilm transport providing alignment, precise reflective optics and avoid "ripple effects" commonly associated with relatively high speed systems. Other features and advantages of the present invention will become apparent from the following more detailed description, taken in conjunction with the accompanying drawings, which illustrate, by way of example the principals of the invention.

BRIEF DESCRIPTION OF THE DRAWING

FIG. 1 is a front view of an electrical schematic diagram illustrating the capstan servo board of one embodied form of the unique high-volume projector and rotary xerographic processor in accordance with the present invention;

DESCRIPTION OF THE PREFERRED EMBODIMENT

Figure 2:
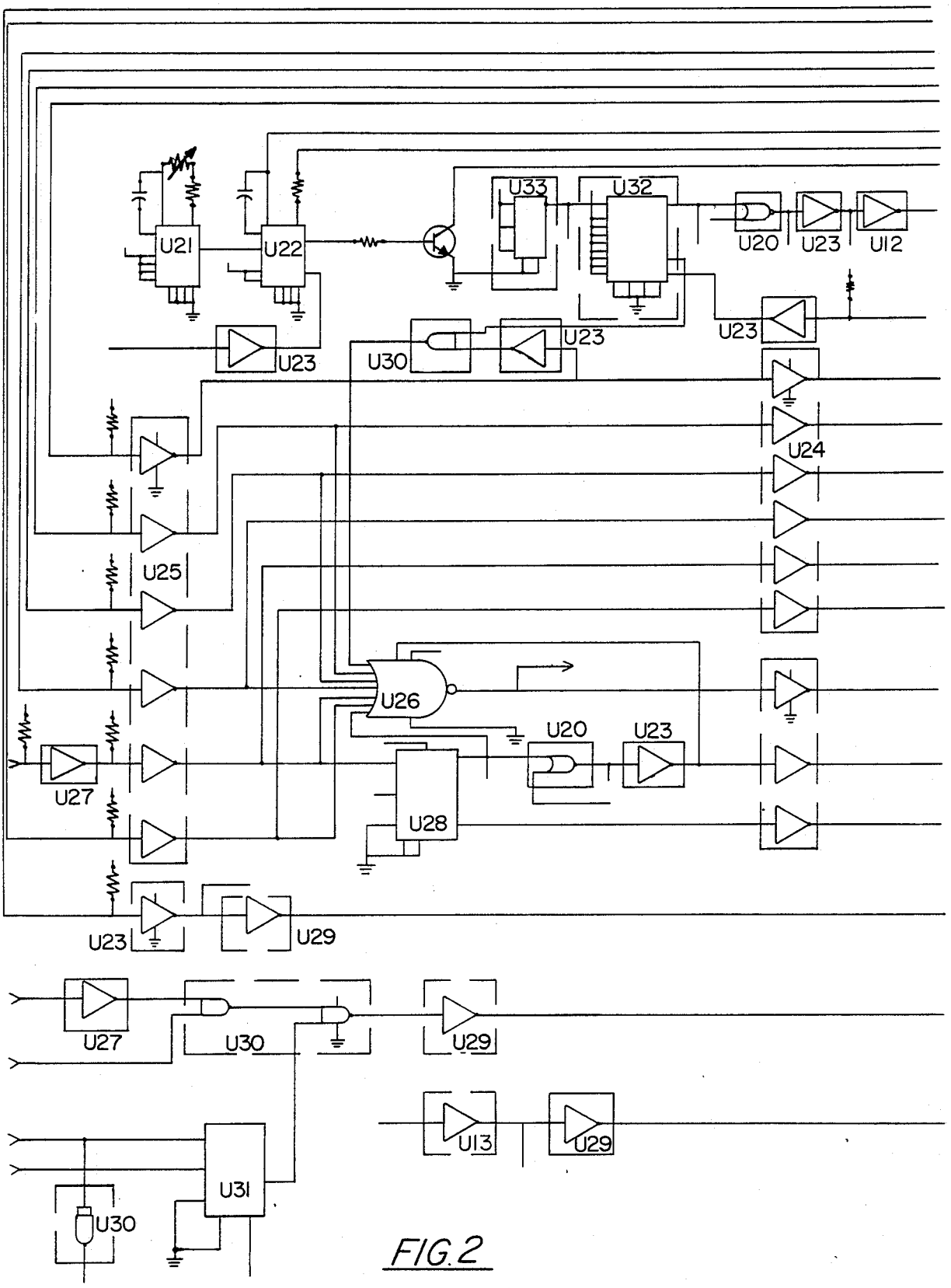
FIG. 2 is a schematic electrical diagram illustrating one electrical circuit of the system control for the unique high volume projector and rotary xerographic processor in accordance with one embodiment of the present invention.
Figure 3:
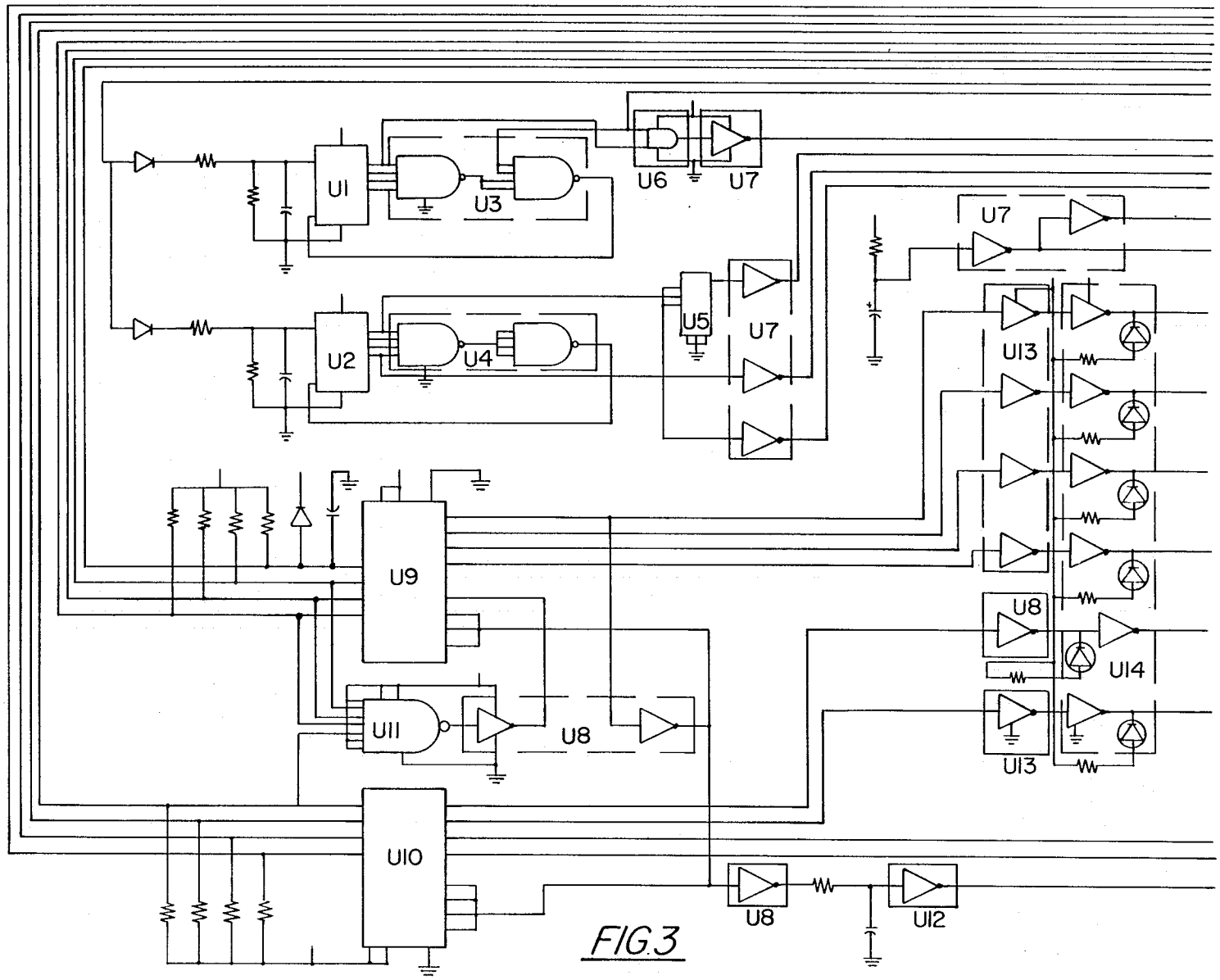
FIG. 3 is a schematic electrical diagram of a second component of the system control circuitry for one embodiment of the unique high-volume projector and rotary xerographic processor in accordance with the present invention.
Figure 4:
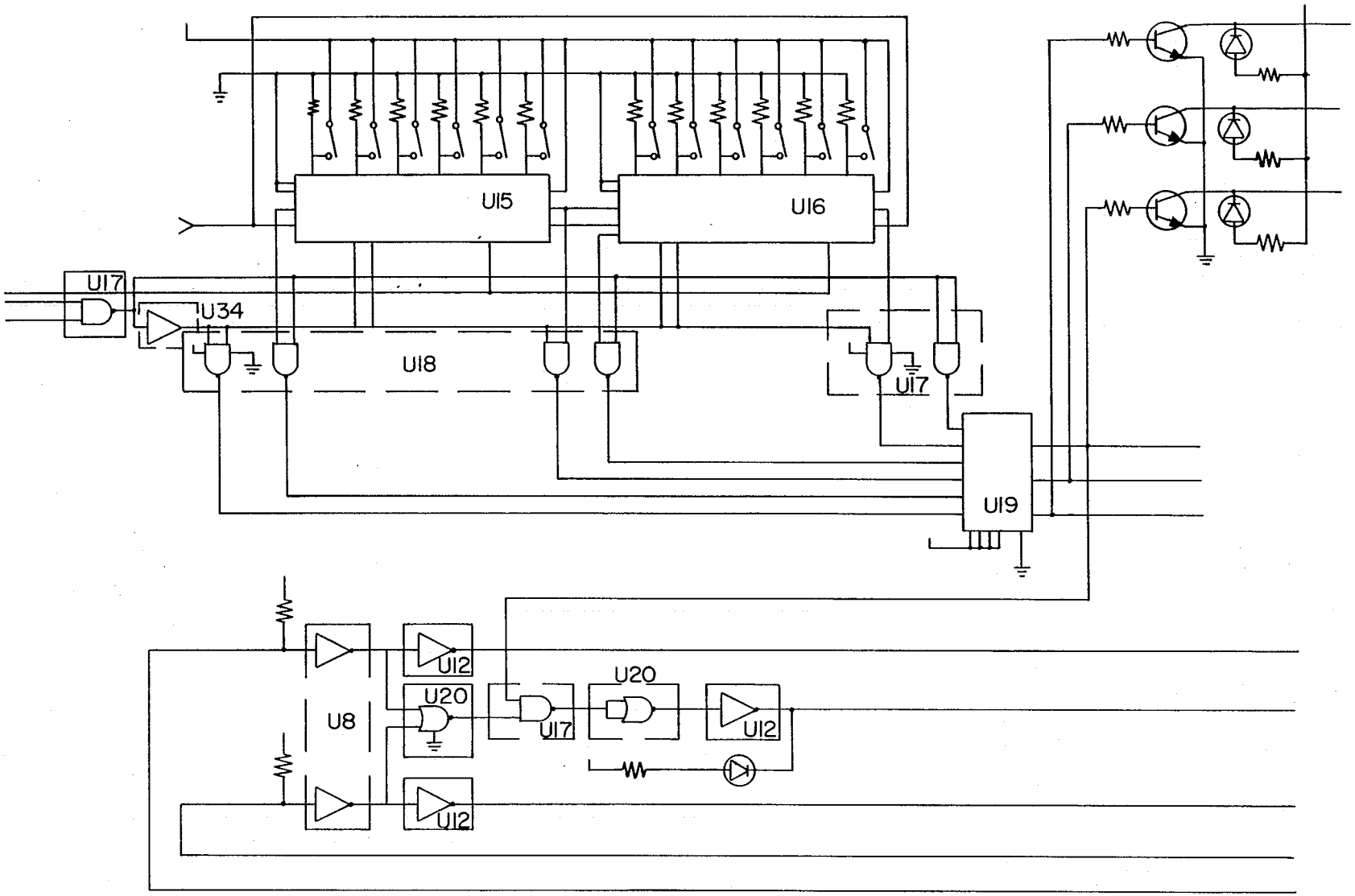
FIG. 4 is a schematic electrical diagram of yet a third component of the system control of one embodied form of the unique high-volume projector and rotary xerographic processor.
Figure 5:
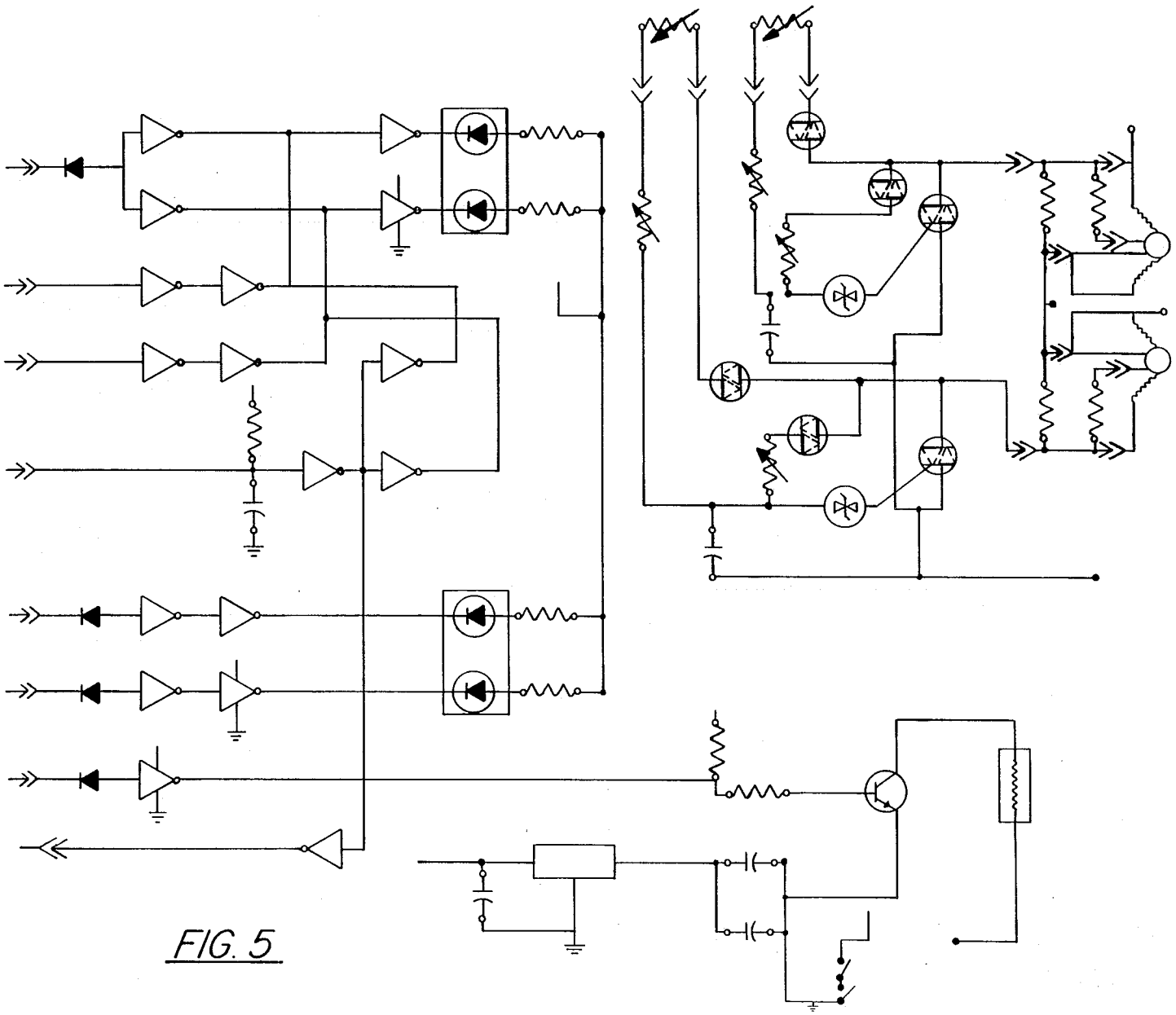
FIG. 5 is a schematic electrical diagram of the reel control mechanism in accordance with one embodied form of the unique high-volume projector and rotary xerographic processor in accordance with the present invention.

As show in the drawings for purposes of illustrating, the present invention is embodied in an improved high-volume projector rotary xerographic processor, and method therefore.

In one embodied form, the unique apparatus produces dry permanent positive copies from continuously fed microfilm which can be reproduced on an appropriate substrate, preferably, plain paper, continuously fed by rolled at a rate of at least 52 feet per minute.

Accordingly, the inventive apparatus and method minimizes the occurrence of blurred images through a unique monitoring system which regulates the microfilm transport providing necessary alinement, precise reflective optics and thereby avoiding "ripple effect" commonly associated with relatively high speed reproductive system.

In more detail, the xerographic processor contains all components necessary to reproduce the image from the projection component apparatus.

The processor comprises an aluminum drum coated with a photosensitive selenium surface that is rotatable by a synchronous motor associated with drive means such as a gear reduction box. The processor further comprises charge corotron means; transfer corotron, preclean corotron means and brush housing means.

As the drum rotates, the drum is charged by the charge corotron means. Light from the lens means then strikes the selenium surface. The exposed surface then passes under the developer housing means where developer reagent cascades over the drum surface means, developing the film image. The reproduction substrate, for instance, paper, contacts the drum, transferring the image thereon by way of the transfer corotron means. Thereafter, the paper is carried through fuser means where the image is permanently fused to the paper. Thereafter, the now imaged paper continues through the paper feed roll means to the take up shaft means where it is respooled. Concurrently, the drum continues to rotate past the preclean corotron means to the brush housing means. Therein, the drum means is brushed and vacuumed by brush and vacuum means before being recharged for continuous operation.

The inventive projector component of the apparatus is capable of imaging either 16 or 35 MM film, which can be accommodated by unique interchangeable film idler means. The microfilm is transported across film gate means via capstan motor means. A light source preferably is a 400 W Tungsten-Halogen lamp, although other suitable light means may be used for this purpose. As the microfilm is transported, an image is projected through the lens means to a set of mirrors. Within the optical mirror means, a plurality of electrically adjustable mirrors are oriented in a prescribed manner to determine the appropriate magnification of the microfilm. A mirror image is then reflected to the selenium surface of the drum means referred to above.

OPERATION OF EQUIPMENT

Figure 6:
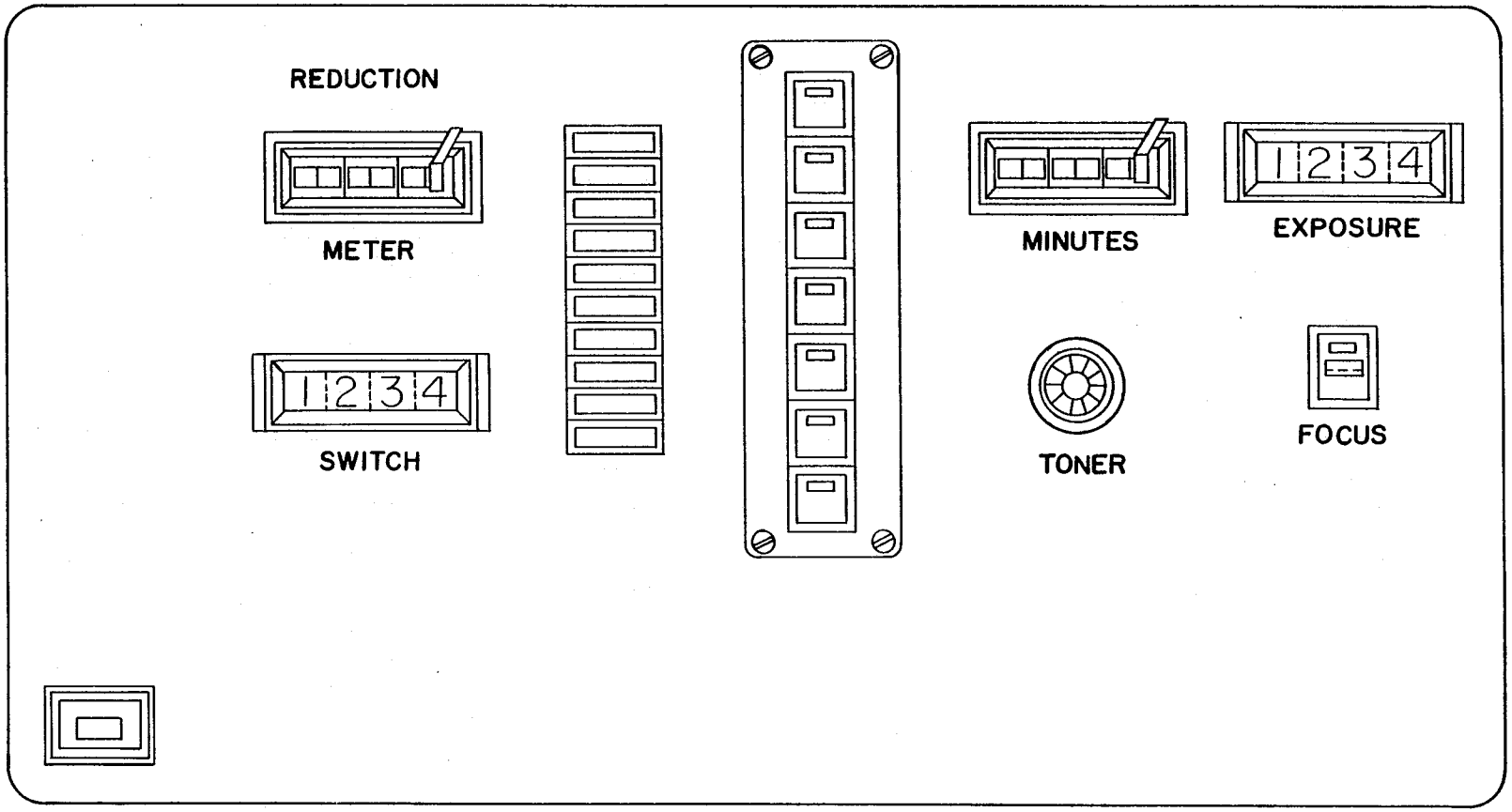
Figure 7:
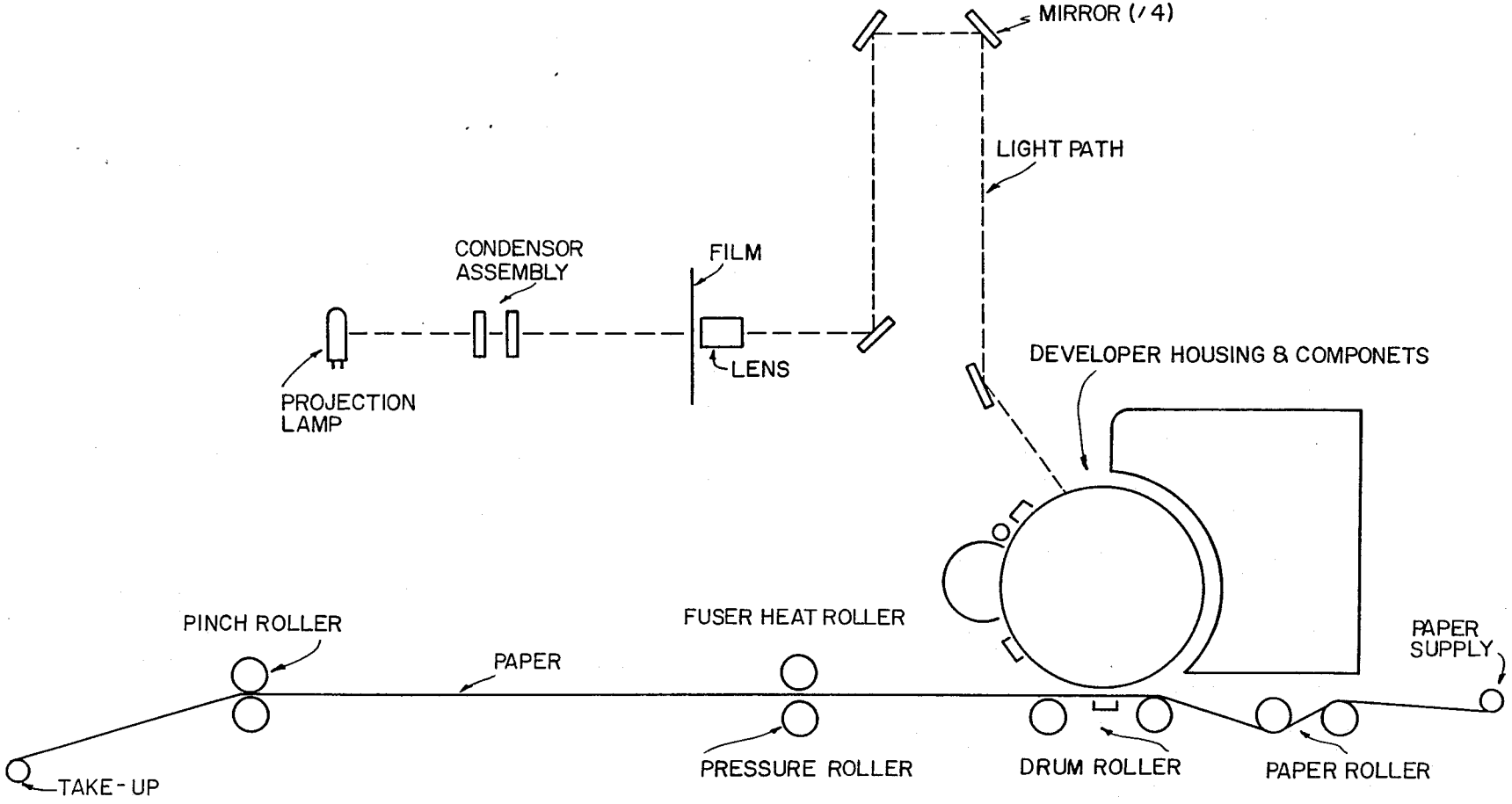

Reference to FIG. 6, the following description will be helpful to a further understanding of the operation of the unique apparatus.

As shown in FIG. 6, an operator of the apparatus will turn on the projector and rotary xerographic processor to warm the equipment by pressing the power switch. After the operator loads the film on the film transport, a status lamp will indicate ready. By depressing the run button an electronic control board will sequence the unique apparatus in appropriate order. These include three basic operations:

1. Control board will turn on the filter means and brush means for cleaning, drum drive means, developer means, high voltage means, and paper drive means.
2. The electronic control board will raise the pressure roller means for fusing, and initiate toner at preset intervals.
3. The electronic control board will transport the film by initiation of the capstan pressure roller means and initiation of the exposure lamp.

The foregoing steps are each controlled by the system control boards (FIG. 1-5). When power is applied to the apparatus, a power on reset is created on the control board (FIG. 1-5). This reset clears all electronic functions and puts the apparatus into a stop mode. Thereafter, a time base generator started by way of electron circuit chips U1, U2, U3 and U4. These time base generator signals are used to create three different clock pulses by way of integrated circuit chips U5 and U7.

Clock 1—Is a 2Hz signal which through IC's U28, U26, U20, U23, and U29, determines whether the machine has proper power supply and clock voltages.

Clock 2—In conjunction with the pressing of the run button, Clock 2 will initiate Steps 1-3 via variable length shift registers U15 and U16. The timing of the shift registers is controlled by the on board selector switch A17.

By using A17 we can program the timing in between steps to insure proper sequence of the apparatus.

The film capstan pressure roller is controlled by use of IC's U8, U12, U17, and U20. In any of the jog situations the pressure roller is released.

IC's U14, U13, U9, U11, and U10 all control the function switches and their lamps. IC's U23, U24, U25, U26, U27, and U29 are all used to monitor the status of the inventive apparatus. The status indicators andfunction switch descriptions are located in Section II.

FUNCTION SWITCHES

The function switches are the means by which the operator controls the inventive apparatus. Listed below are the function switches and their operations:

Stop
Run
Auto Forward
Auto Rewind
Jog Forward
Jog Rewind
Film Tension

Stop—red—stops the inventive apparatus run cycle. Also, stops Auto Forward and Auto Rewind of the film transport.

Run—green—starts the inventive apparatus operation.

Auto Forward—yellow—automatically advances film forward.

Auto Rewind—white—automatically rewinds film.

Jog Forward—yellow—slow advancement of film. Can also be used while machine is in Run cycle.

Jog Rewind—white—slow rewind of film. Can also be used while machine is in Run cycle.

Film Tension—yellow—used to relieve tension from film.

STATUS LAMPS

The status lamps monitors all of the functions that the operator is responsible for. Listed below are the indicators and their conditions:

Ready
Interlock
System Fail
Paper Out
System Error
Film Out
Low Temp
High Temp
Reduction
Low Toner Ready—green lamp—indicates to the operator that the inventive apparatus has met all conditions for a successful run.

Interlock—red lamp—indicates that not all the doors or covers are closed, or that the focus mirror is in the up positive.

Sys. Fail—red lamp—system failure indicates a failure in one of the electronic control functions. Notify local service personnel.

Paper Out—red lamp—indicates the inventive apparatus is out of paper.

Sys. Error—red lamp—system error occurs when any of the status lamps are on (except ready) and the operator tries to operate the inventive apparatus.

Film out—red lamp—indicates that the inventive apparatus is out of film.

Low Temp—red lamp—until the fuser heat roller comes up to proper operating temperature, the Low Temp indicator will be on. The initial warm up time is approximately four (4) minutes.

High Temp—red lamp—indicates that the inventive apparatus is in an over-heat condition. Also at this time, the Sys. Fail indicator will come on. Notify local service personnel.

Reduction—red lamp—indicates that the mirrors have not moved to proper magnification.

Low Toner—yellow lamp—indicates that the toner supply is nearly depleted. Refill as soon as possible. NOTE: With any indicator on except for Low Toner and Ready, the inventive apparatus will not start, or will shut down if already in a run mode.

From the foregoing, it will be appreciated that the present invention provides a high-volume projector and rotary xerographic processor which produces dry, permanent positive copies from continuous fed microfilm which can be reproduced on plain paper which is continuously fed by rolls at a rate of at least 52 feet per minute. Although a preferred embodiment of the invention has been shown and described, it will be apparent that other adaptations and modifications can be made without departing from the spirit and scope of the invention. Accordingly, the invention is not to be limited, except by the following claims.

We claim:

1. Apparatus for production of dry, permanent, positive copies from continuous fed microfilm, said apparatus comprising in combination:

(a) processor means including an aluminum drum means coated with a photosensitive surface, said drum means being rotatable by a synchronous motor means associated with drive means;

(b) charge corotron means;

(c) transfer corotron means;

(d) preclean corotron means and brush housing means;

(e) exposure means for directing light in image configuration through a lens means onto said photosensitive surface;

(f) developer means for directing the exposed photosensitive surface to developer housing means for contact with developer reagent to develope a film image;

(g) feed means for guiding a reproduction substrate to contact said exposed photosensitive surface at a rate of at least 52 feet per minute to cause transfer of said image on said photosensitive surface means to said substrate by interaction with said transfer corotron means;

(h) fuser means for transporting said substrate and permanently fusing said image to said substrate;

(i) transport for delivery of said imaged substrate through feed roll means to takeup shaft means to respool said imaged substrate;

(j) cleaning means to clean said photosensitive surface means including brush and vacuum means to clean said fused substrate after said surface has been fused with said substrate and before being recharged for continuous operation.

2. The apparatus as defined in claim 1, wherein said drum mean is fabricated from aluminum and includes a photosensitive selenium surface.

3. The apparatus as defined in claim 2, wherein said drive mean comprises a gear reduction box.

4. The apparatus as defined in claim 1, wherein said reproduction substrate is plain paper.

* * * * *